US006085683A

United States Patent [19]

French et al.

[11] Patent Number: 6,085,683

[45] Date of Patent: Jul. 11, 2000

[54] UNDERWATER DEPOLYABLE TESTING PLATFORM

[75] Inventors: Daniel W. French, Portsmouth; John J. Vaillancourt, Tiverton; Robert N. Carpenter, Portsmouth; Richard R. Shell, Riverside, all of R.I.

[73] Assignee: The United States of America as represented by the Secretary of the Navy, Washington, D.C.

[21] Appl. No.: 09/144,892

[22] Filed: Sep. 1, 1998

[51] Int. Cl.[7] ..... B63B 35/00

[52] U.S. Cl. ..... 114/258; 114/259; 114/382

[58] Field of Search ..... 114/343, 382, 114/258, 259; 367/173

[56] References Cited

U.S. PATENT DOCUMENTS

| | | | |
|---|---|---|---|
| 2,837,727 | 6/1958 | Mayes | 367/173 |
| 3,565,217 | 2/1971 | St. Louis | 114/258 |
| 3,740,706 | 6/1973 | Joseph | 367/173 |

FOREIGN PATENT DOCUMENTS

| | | | |
|---|---|---|---|
| 61-24690 | 2/1986 | Japan | 114/259 |

*Primary Examiner*—Sherman Basinger

*Attorney, Agent, or Firm*—Michael J. McGowan; James M. Kasischke; Prithvi C. Lall

[57] ABSTRACT

An underwater testing platform assembly includes first and second rails for disposition in part in a body of water, each of the rails having facility for connection to a surface vessel. The rails are disposed vertically, and parallel to each other. A cage comprising a network of struts is mounted on the rails. A skid is mounted on, and is movable in, the cage, and can receive and retain an apparatus to be tested. First and second travelers are fixed to the cage and are movably mounted, respectively, on the rails, such that the cage is vertically movable on the rails. Instrumentation is mounted on the cage. A transmission line is connected at a first end to the instrumentation and extends to the surface vessel. A receiver on the surface vessel has a second end of the transmission line connected thereto and receives data signals from the instrumentation.

18 Claims, 5 Drawing Sheets

UNDERWATER DEPOLYABLE TESTING PLATFORM

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The invention relates to platforms for testing various underwater devices and is directed more particularly to a platform assembly which has facility for attachment to a surface vessel and for being lowered beneath the water surface and retained in an underwater position, and which can be moved about in the water similarly to an underwater vehicle.

(2) Description of the Prior Art

To obtain an underwater test of a new apparatus, as for example, a sonar receiver, it has been common practice to place the receiver on a submersible vehicle, such as a submarine or an unmanned underwater vehicle, which is able to travel and maneuver underwater. In view of budget restraints, it has become increasingly more difficult to obtain submersibles for the purpose of testing underwater devices.

Accordingly, there is a need for a test platform assembly, which provides facility for underwater testing and which is movable through the water and maneuverable, similar to a submersible, but not requiring a submersible vehicle.

SUMMARY OF THE INVENTION

It is, therefore, an object of the invention to provide a platform assembly for attachment to a surface vessel, and which is adapted for disposition, in part, underwater, and which is susceptible to being moved through the water and maneuvered therein.

With the above and other objects in view, as will hereinafter appear, a feature of the invention is the provision of an underwater testing platform assembly comprising first and second rails for disposition in part in a body of water. Each of the rails is adapted for connection to a surface vessel, and the rails are vertically oriented and spaced from each other in a substantially parallel manner. A cage is mounted on the rails and comprises a network of struts. A skid is mounted on, and is movable in, the cage and is adapted to receive and retain apparatus to be tested. First and second travelers are fixed to the cage and are respectively movably mounted on the first and second rails, such that the cage is vertically movable on the first and second rails. Instrumentation is mounted on the cage. A transmission line is connected to the instrumentation and extends to a receiver on the surface vessel. The receiver is adapted to receive data signals from the instrumentation.

In accordance with a further feature of the invention, there is provided an underwater testing assembly comprising a surface vessel having first and second connection structures on deck proximate a side of the vessel and spaced from each other. Third and fourth connection structures are fixed on a hull portion of the vessel and on the same side of the vessel, each of the third and fourth structures being in substantially vertical alignment with one of the first and second structures. The assembly further includes a test platform comprising first and second rails for disposition in part in water supporting the vessel. The rails are substantially parallel and are disposed substantially vertically. The assembly still further includes a test platform cage movably attached to the rails for disposition beneath the water, the first rail being connectingly engageable with the first and third connection structures, and the second rail being connectingly engageable with the second and fourth connection structures, such that the test platform cage is attachable to the vessel by the first, second, third and fourth connection structures.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent, wherein corresponding reference characters indicate corresponding parts throughout the several views of the drawings and wherein.

DESCRIPTION OF THE PREFERRED EMBODIMENT

Figure 1:
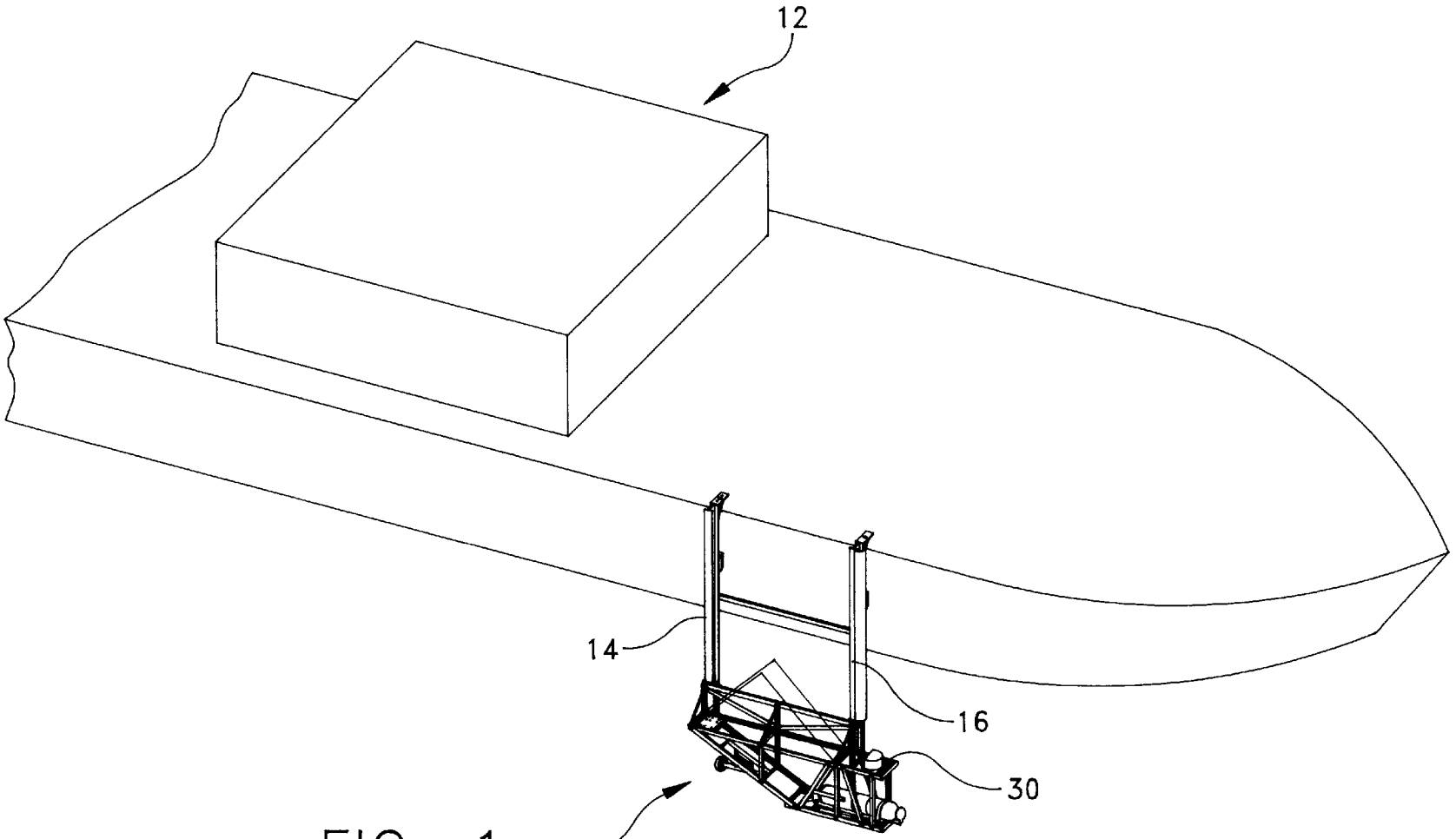
FIG. 1 is a diagrammatic perspective view of a surface vessel and platform assembly illustrative of an embodiment of the invention.

Referring to FIG. 1, it will be seen that the platform assembly 10 of the present invention is adapted for connection to a surface vessel 12.

Figure 2:
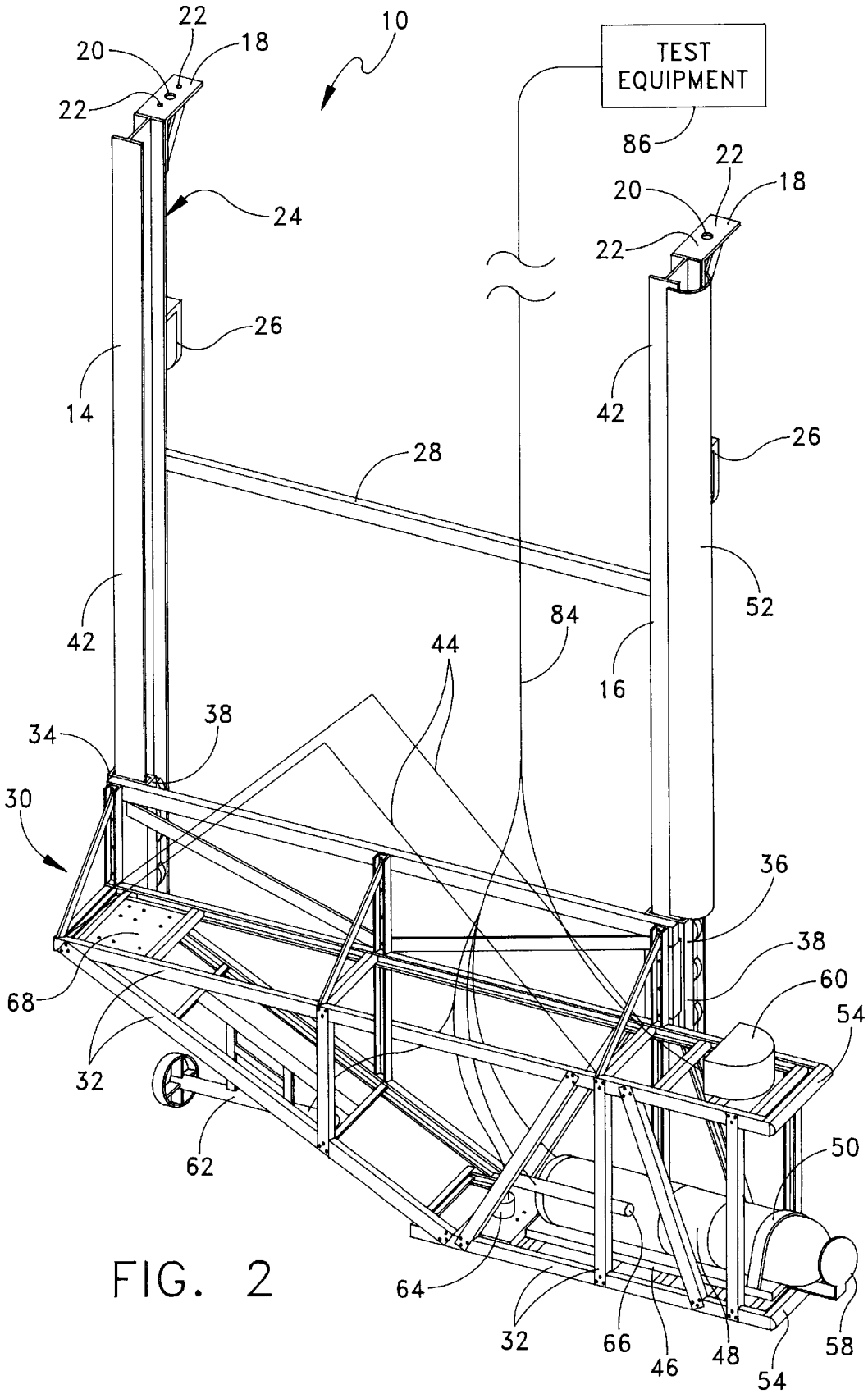
FIG. 2 is a perspective bow and outboard view, in part diagrammatic, of the platform assembly of FIG. 1, and further illustrative of the embodiment of the invention.

Turning to FIG. 2, the platform assembly 10 is seen to include first and second rails 14, 16, preferably of a steel I-beam construction. At the upper end of each rail 14, 16, there is fixed a mounting plate 18 having a hole 20 therein and a plurality of smaller orifices 22. Fixed to inboard surfaces 24 of rails 14, 16 are rail tabs 26. The mounting plates 18 and tabs 26 provide platform assembly 10 with a four-point attachment facility for connection of the platform assembly to surface vessel 12, as will be further described hereinbelow. One or more rigid beams 28 may be connected to rails 14, 16 to provide strength and rigidity to the assembly and to maintain the rails substantially parallel to one another.

Figure 3:
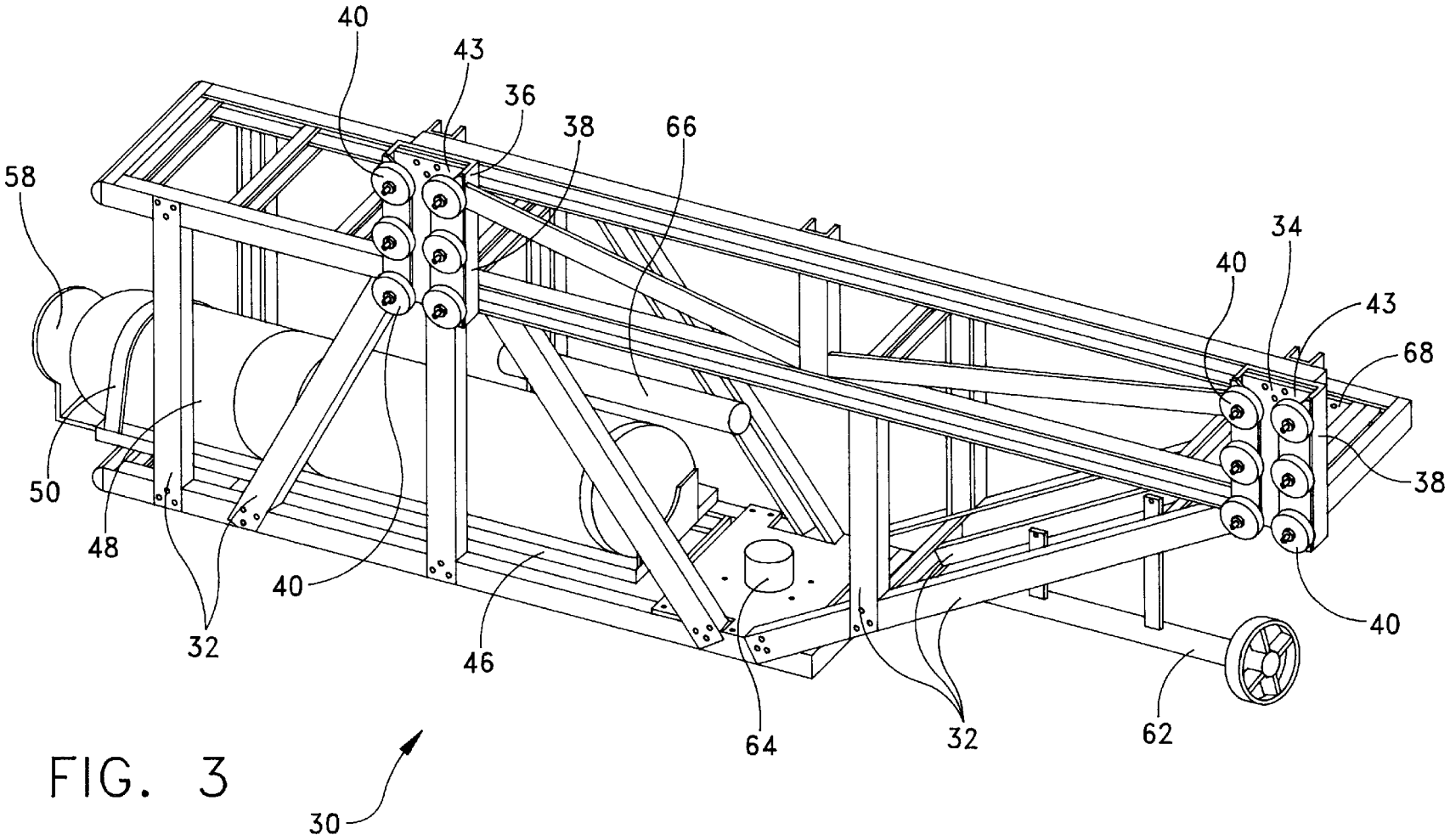
FIG. 3 is a perspective stern and inboard view of a portion of the platform assembly of FIG. 2.
Figure 4:
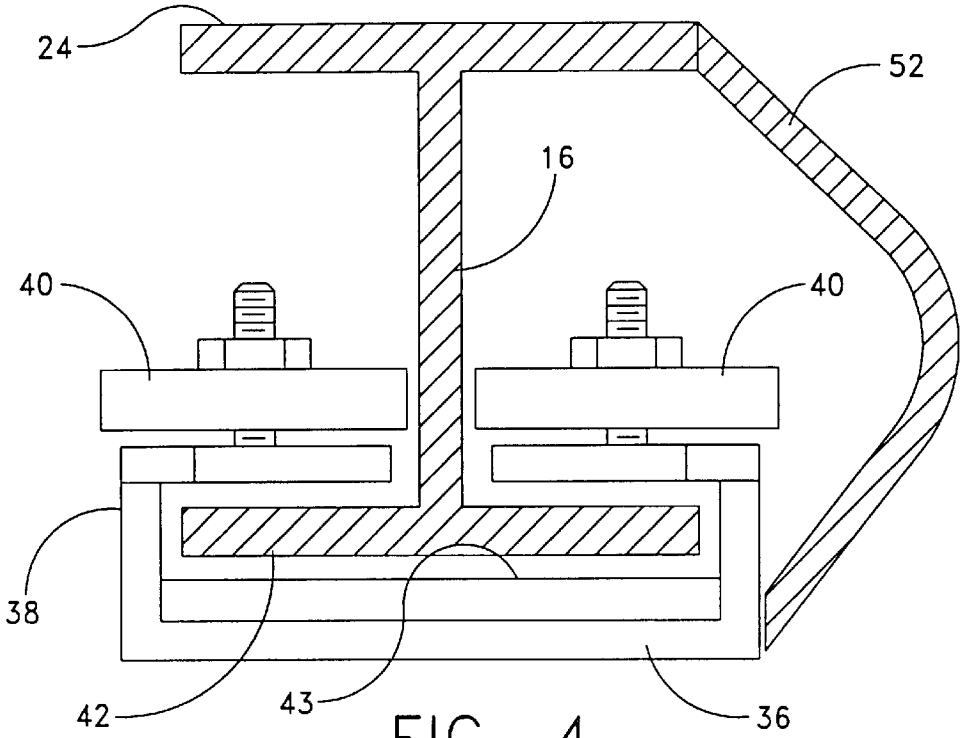
FIG. 4 is a top plan view of one rail of the platform assembly of FIG. 2.

Movably mounted on rails 14, 16 is a cage 30 (shown mounted on rails 14, 16 in FIG. 2 and removed from rails 14, 16 in FIG. 3) which comprises a network of struts 32. Fixed to cage 30 are first and second travelers 34, 36. The first traveler 34 is movably mounted on the first rail 14, and the second traveler 36 is movably mounted on the second rail 16. Referring to FIGS. 3 and 4, it will be seen that each traveler includes a housing 38 on which are mounted rotatable wheels 40, the housing 38 and wheels 40 being so arranged as to lock onto an outboard portion 42 (FIG. 4) of the associated rail 14, 16. The interior 43 of traveler housing 38 is coated with Delrin™ , or the like, which becomes very slippery when wet. Thus, the wheels 40 of the travelers 34, 36 are able to move in the middle grooves of the I-beam rails, and the traveler housings 38 are readily slidable up and down the rails 14 and 16.

The cage 30 is provided with one or more harnesses 44, (FIG. 2) by which cage 30 may be raised and lowered on rails 14, 16. A crane (not shown) on the deck of surface vessel 12 is utilized to raise and lower the cage.

In FIGS. 2 and 3, there is shown a particular assembly of instruments and components for testing mine-hunting sonar and, more particularly, for testing a sonar receiver designed for use in mine-hunting operations. It will be apparent that for other purposes other instruments and components may be substituted.

Figure 7:
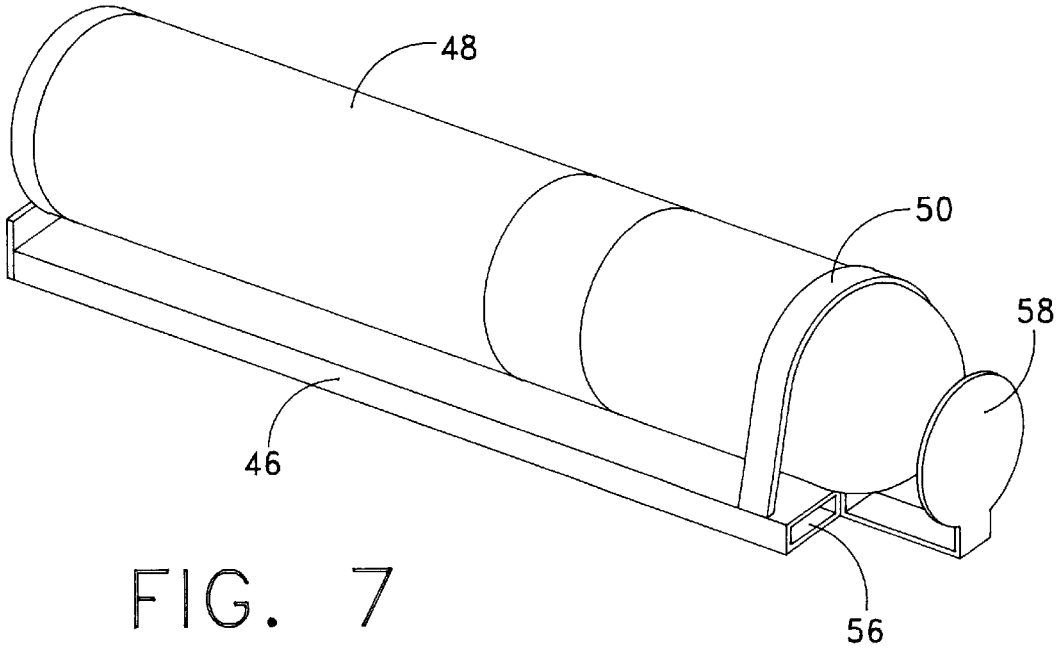
FIG. 7 is a perspective view of a skid portion of the platform assembly of FIGS. 2 and 3.

The cage 30, as illustrated in FIG. 2, is provided with a skid 46 (shown independently of cage 30 in FIG. 7) which is movable lengthwise out of and into cage 30 and is adapted to be locked in place in the cage (locking mechanism not shown). The skid 46 is adapted to receive an apparatus 48 which is to undergo testing. The apparatus 48 may be secured to skid 46 by straps 50, or the like. The skid 46 is provided with two elongated pockets 56 (one shown in FIG. 7) for receiving tongues of a fork-lift (not shown), by which the skid 46 may be moved out of, and into, the cage 30. The skid further is provided with a shield 58 for protecting test apparatus 48.

The rail 16 is provided with a leading edge fairing 52 (FIGS. 2 and 4) to reduce drag of the platform assembly through a water environment. Similarly, smaller leading edge fairings 54 may be fixed to various leading struts to reduce drag.

In the illustrative configuration, there is mounted on cage 30 a sonar transducer, or "pinger" 60 (FIG. 2) for sending out detection signals. A side scan sonar 62 enables mapping of the ocean bottom; a velocity sensor 64 provides data from which can be determined speed over the ocean bottom; and a water conductivity and density sensor 66 provides data from which the water conductivity and density can be determined.

The cage 30 is further provided with a deck 68 for receiving weights, if needed (not shown) for counterbalancing the weight of test apparatus 48.

Figure 5:
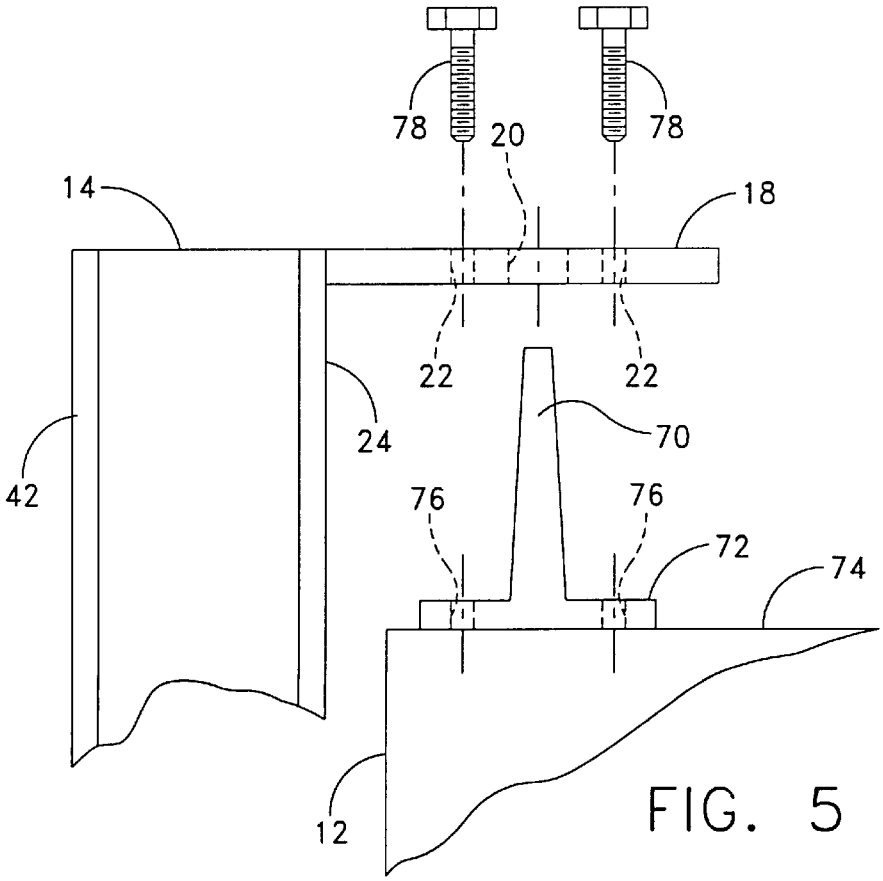
FIG. 5 is a diagrammatic illustration of means on deck of the surface vessel for securing the platform assembly of FIG. 2 to the deck of the surface vessel.

Referring to FIG. 5, it will be seen that the surface vessel 12 is provided with a pole 70 upstanding from a plate 72 fixed to a deck 74 of vessel 12. The mounting plate hole 20 is adapted to receive pole 70 and to slide down pole 70 to engage plate 72. The mounting plate orifices 22 are alignable with threaded holes 76 in the plate 72. Threaded bolts 78 extend through orifices 22 and into threaded holes 76 to secure plate 18 to plate 72.

The surface vessel 12 is provided with a second pole assembly of the type shown in FIG. 4 and described immediately above, such that the mounting plates 18 of both rails 14, 16 may be secured to surface vessel deck 74, to provide two points of interconnection between platform assembly 10 and surface vessel 12.

Figure 6:
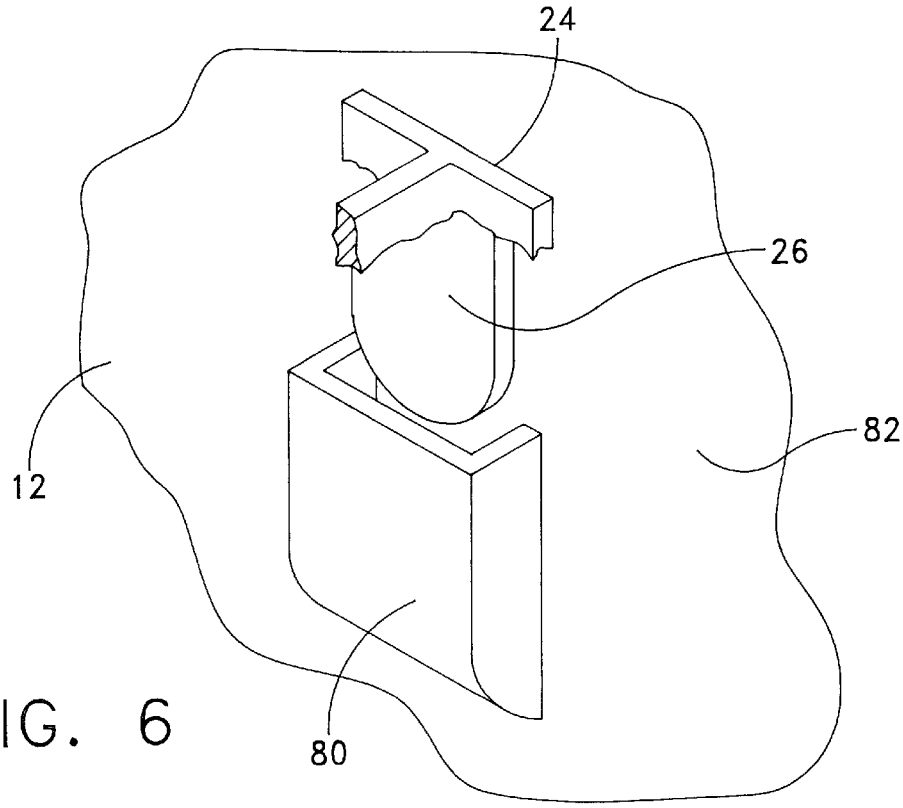
FIG. 6 is a diagrammatic illustration of a means on the surface vessel hull for securing the platform assembly of FIG. 2 to the hull of the surface vessel.

The surface vessel is further provided with two U-shaped brackets 80 fixed to a side 82 (FIG. 6) of surface vessel 12 above the water line. Each rail tab 26 is adapted to enter one of the brackets 80 to provide two additional points of interconnection between platform assembly 10 and surface vessel 12.

A transmission line 84 (FIG. 2) is connected at its lower end to each of the sensors 62, 64, 66 and to the test apparatus 48 and pinger 60. At its upper end, transmission line 84 is connected to test equipment 86, such as a computer adapted to receive signals from the various sensors and test apparatus, and to provide data interpretations required.

In operation, skid 46 is removed from cage 30, preferably by use of a fork-lift, the tongues of which are inserted into pockets 51, such that the skid 46 may be slightly lifted and moved forwardly out of the cage. A test apparatus, such as apparatus 48, is fixed in place on the skid, and the skid 46 and test apparatus 48 are slid back into cage 30 and locked therein. If not previously done, appropriate sensors are mounted on cage 30 and transmission line 84 is fixed thereto. If needed, weights are secured on deck 68.

The platform assembly 10 is then lifted by crane, using the harness 44, and brought alongside surface vessel 12 in the vicinity of the poles 70 and the brackets 80. The platform assembly 10 is lowered and guided such that tabs 26 enter brackets 80 and poles 70 enter mounting plate holes 20. The platform assembly 10 is further lowered until mounting plates 18 engage deck plates 72 and are secured thereto by bolts 78.

The transmission line 84 is connected to the test equipment 86 on surface vessel 12.

The crane is then operated to lower cage 30 on rails 14, 16, the travelers 34, 36 moving down the rails, until the cage is underwater and disposed at the lower ends of the rails. The rails are provided with stops (not shown) which prevent downward movement of cage 30 beyond the lower ends of rails 14, 16.

Once platform assembly 10 is in operative position, the crane is removed and surface vessel 12 moves forwardly to attain the speed at which tests are desired to be run. As the assembly moves forwardly, the sensors 62, 64, and 66 gather information as to the ocean bottom, the speed of the test apparatus over the ocean bottom, and water conductivity and density.

The pinger 60 is activated to send out signals. Upon encountering a mine, or other metallic object, the signals are reflected back to the cage and picked up by test apparatus 48. The operations of the pinger 60 and test apparatus 48, as well as the sensed parameters of the water and ocean bottom, are all fed into the test equipment 86, through the transmission line 84.

As noted above, the particular components and sensors can vary. For example, test apparatus 48 having capability for both pinging and receiving reflected pings can be mounted on skid 46 and tested.

It will be understood that many additional changes in the details, materials, steps and arrangement of parts, which have been herein described and illustrated in order to explain the nature of the invention, may be made by those skilled in the art within the principles and scope of the invention as expressed in the appended claims.

What is claimed is:

1. An underwater testing platform assembly comprising:

first and second rails for disposition in part in a body of water, each of said rails being adapted for connection to a surface vessel, said rails being further adapted for disposition substantially vertically and spaced from each other and substantially parallel to each other;

a cage mounted on said rails and comprising a network of struts;

a skid mounted on and movable in said cage and adapted to receive and retain apparatus to be tested;

first and second travelers fixed to said cage, said first traveler being movably mounted on said first rail and said second traveler being movably mounted on said second rail, such that said cage is vertically movable on said first and second rails;

instrumentation mounted on said cage;

a transmission line connected at a first end to said instrumentation and for extending to the surface vessel; and a receiver having a second end of said transmission line connected thereto and adapted to receive data signals from said instrumentation.

2. The platform assembly in accordance with claim 1 wherein said rails are each provided with a mounting plate at an upper end thereof for attachment to a deck of the surface vessel to effect, in part, the connection of said rails to the surface vessel.

3. The platform assembly in accordance with claim 2 wherein each of said rails has an inboard surface located toward the surface vessel, said platform assembly further comprising:

at least one bracket for each rail adapted to be joined to the surface vessel; and a tab joined to each rail inboard surface and configured for receipt by said bracket for connecting said rails to the surface vessel.

4. The platform assembly in accordance with claim 2 wherein each of said mounting plates is provided with a hole therethrough adapted to receive an upstanding pole fixed to a deck of the surface vessel.

5. The platform assembly in accordance with claim 1 wherein each of said travelers is provided with wheels which ride along opposite sides of one of said rails.

6. The platform assembly in accordance with claim 5 wherein each of said rails has an outboard surface located away from the surface vessel; and each of said travelers includes a housing on which said wheels are rotably mounted, and which is slidably movable along the rail outboard surface.

7. The platform assembly in accordance with claim 1 wherein said instrumentation includes sensors for detecting ocean water parameters, ocean bottom configuration, and speed of the assembly over the ocean bottom.

8. The platform assembly in accordance with claim 1 wherein said network of struts comprises a multiplicity of struts spaced sufficiently from one another to permit water flow through said cage.

9. The platform assembly in accordance with claim 8 wherein at least some of said struts are provided with leading edge fairings on forward surfaces thereof to facilitate smooth flow of water therearound.

10. The platform assembly in accordance with claim 8 and further comprising a deck mounted on said cage at an end of said cage removed from another end of said cage on which said skid is mounted, said deck being adapted to receive weights for counterbalancing said skid and the apparatus mounted thereon to be tested.

11. The platform assembly in accordance with claim 1 wherein at least a forward-most one of said rails is provided with a leading edge fairing fixed thereto and extending over a forward surface thereof to facilitate smooth flow of water therearound.

12. The platform assembly in accordance with claim 1 wherein said skid is provided with elongated pockets for receiving tongues of a fork-lift, by which said skid may be moved out of and into said cage.

13. The platform assembly in accordance with claim 1 wherein said assembly further includes a harness fixed at either end to said cage and by which said cage may be pulled by a crane upwardly on said rails and released to move downwardly on said rails.

14. An underwater testing assembly comprising:

a surface vessel having a hull portion;

first and second connection structures proximate a side of said vessel and spaced from each other;

third and fourth connection structures on the hull portion of said vessel and on said side of said vessel, each of said third and fourth structures being in substantially vertical alignment with one of said first and second structures; and a test platform assembly comprising:

first and second rails for disposition in part in water supporting said vessel, said rails being substantially parallel and disposed substantially vertically, and said rails each being provided with a mounting plate at an upper end thereof, and each mounting plate being connectable to one of said first and second surface vessel connection structures, each of said mounting plates being provided with a hole therethrough, and each of said first and second connection structures including an upstanding pole configured and sized to pass through said hole; and a test platform cage movably attached to said rails for disposition beneath the water, said first rail being connectingly engageable with said first and third connection structures, and said second rail being connectingly engageable with said second and fourth connection structures, such that said test platform cage is attachable to said vessel by said first, second, third and fourth connection structures.

15. The testing assembly in accordance with claim 14 wherein said rails are each provided with a tab fixed thereto extending inboard toward said vessel and downwardly and is connectable to one of said third and fourth connection structures.

16. The testing assembly in accordance with claim 15 wherein each of said third and fourth connection structures comprises a generally U-shaped bar fixed at both ends to said hull portion and defining a slot for receiving one of said tabs.

17. The testing assembly in accordance with claim 14 and further comprising:

instrumentation mounted on said cage for sensing ocean data;

a transmission line connected at a first end to said instrumentation and extending to said surface vessel; and test equipment disposed on said vessel and having a second end of said transmission line connected thereto, said test equipment being adapted to receive signals from said instrumentation.

18. The testing assembly in accordance with claim 17 wherein said cage comprises a network of struts spaced apart for flow of water therethrough and supporting said instrumentation and an apparatus to be tested.

* * * * *

UNITED STATES PATENT AND TRADEMARK OFFICE

CERTIFICATE OF CORRECTION

PATENT NO : 6,085,683

DATED : 11 JULY 2000

INVENTOR(S) : DANIEL W. FRENCH, ET AL

It is certified that error appears in the above-identified patent and that said Letters Patent is hereby corrected as shown below:

In the title, replace "DEPOLYABLE" with "DEPLOYABLE".

Signed and Sealed this

Twenty-second Day of May, 2001

*Attest:*

Nicholas P. Godici

NICHOLAS P. GODICI

*Attesting Officer*

*Acting Director of the United States Patent and Trademark Office*